United States Patent [19]

Rootsey

[11] 3,958,193

[45] May 18, 1976

[54] TAPERED SEPTUM WAVEGUIDE TRANSDUCER

[75] Inventor: James V. Rootsey, Sunnyvale, Calif.

[73] Assignee: Aeronutronic Ford Corporation, Blue Bell, Pa.

[22] Filed: Apr. 23, 1975

[21] Appl. No.: 570,604

[52] U.S. Cl. ..... 333/9; 333/21 A; 333/98 R

[51] Int. Cl.[2] ..... H01P 1/16; H01P 5/12

[58] Field of Search ..... 333/9, 21 R, 21 A, 98 R

[56] References Cited

UNITED STATES PATENTS 3,284,725 11/1966 Bowman ..... 333/21 R X

*Primary Examiner*—Paul L. Gensler

*Attorney, Agent, or Firm*—Robert D. Sanborn

[57] ABSTRACT

A tapered septum in a square waveguide transduces it into a pair of rectangular waveguides. The output waveguides will be excited as a function of the polarization of the signals present in the square waveguide. The septum has a special shape that includes a tapered portion and a transverse portion proportioned to maximize the transducer bandwidth and minimize reflected power.

8 Claims, 7 Drawing Figures

TAPERED SEPTUM WAVEGUIDE TRANSDUCER

BACKGROUND OF THE INVENTION

Tapered waveguide septum action is well known for its polarization selection characteristics. It would appear from simple inspection that the longer a tapered septum is made, the lower will be the discontinuity and better the bandwidth. In fact it has been found that there is an optimum taper and that increasing the length of the taper from optimum increases reflections and reduces bandwidth. Even with an optimum septum taper, reflections are not as low as desired and bandwidth is not as great as desired.

SUMMARY OF THE INVENTION

It is an object of the invention to provide a waveguide septum transducer that provides the desired signal action while providing a better signal match and broader operating bandwidth.

It is a further object to shape a waveguide septum to provide transducer action having both increased operating bandwidth and reduced reflected power.

These and other objects are achieved by employing a septum having a compound shape. A transverse septum portion joins a tapered portion. The taper is made to optimize the transducer action and the transverse portion is selected to provide a match between the transducer input and output ports.

DETAILED DESCRIPTION OF THE PRIOR ART

Figure 1A:
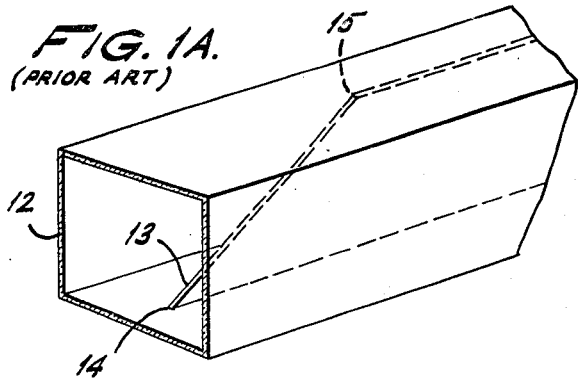
FIG. 1A. (PRIOR ART)
FIG. 1A shows a transducer of prior art design using a conventional tapered septum.
Figure 1B:
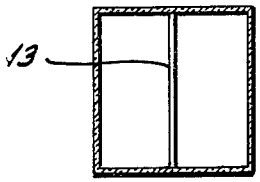
FIG. 1B is an end view of the device of FIG. 1A.

A square waveguide operating in its fundamental transverse electric ($TE_{0,1}$) mode will support signal propagation of any polarization, including circular. In this respect it operates much in the same fashion as does a round waveguide having a diameter equal to 1.17 times the dimension of the side of the square waveguide and operating in its $TE_{1,1}$ mode. FIG. 1A shows such a square waveguide 12 with a tapered septum 13 dividing the square cross section into two rectangular waveguides. The tapered septum is conductive and intersects the waveguide walls at 14 and 15. As can be seen by the end view of the structure, shown in FIG. 1B, the system will act as if the square waveguide is merely coupled to a pair of adjacent rectangular waveguides. If the septum leading edge were transverse across the waveguide, this would be true and the device would act as a simple power splitter for those signals in which the electric vector is orthogonal to the septum. Where the electric vector is parallel to such a vertical septum no propagation will occur. However for the tapered septum as shown in FIGS. 1A and 1B, and in side view in FIG. 1C, a completely different and useful set of conditions prevail.

Figure 1C:
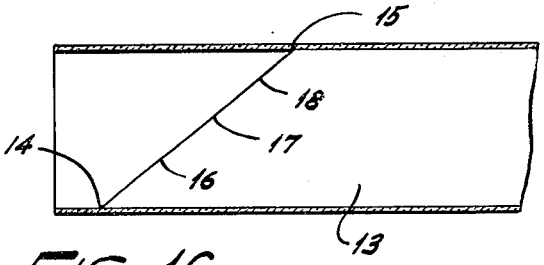
FIG. 1C is a side view of the septum of FIG. 1A.
Figure 2:
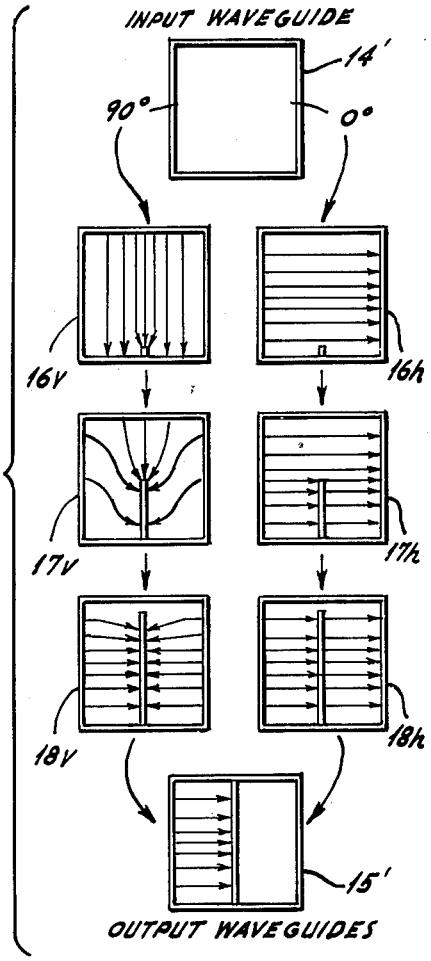
FIG. 2. (PRIOR ART)
FIG. 2 is a sectional showing of the electrical fields in the device of FIG. 1A.

FIG. 2 shows cross sections of waveguide 12 at five different points along the waveguide. The arrows inside the sections show the electric signal vectors. Section 14' represents the waveguide at point 14 of FIG. 1C. The indicated notation relates to a circularly polarized wave moving away from the observer at section 14' toward section 15'. Such a wave can be characterized as a pair of orthogonal electric vectors displaced along the direction of travel by one quarter wavelength or 90°. The horizontal vector reference is indicated as the 0° right hand arrow. The left hand arrow which is shown as the 90° or vertical reference comprises the orthogonal component.

The 0° vector action is shown in the right hand section series labeled **16*h*, 17*h* and 18*h*. The orthogonal or 90° vector action is shown in the left hand section series labeled 16*v*, 17*v*, and 18*v***.

In section 14', which represents waveguide 12 at point 14 of FIGS. 1A and 1C, both signal vectors will be considered to be present equally although not illustrated. At section **16*v* it can be seen that the septum is starting to distort the vertical electric vector. At sections 17*v* and 18*v* the vector is progressively distorted until it has been divided into two opposite horizontal polarized components at section 15' where the septum has completely divided the waveguide 12 into two rectangular waveguides. As can be seen by sections 16*h*, 17*h*, and 18*h*, the horizontal vector is relatively undisturbed and will simply be split into two equal and in-phase components at section 15'**.

In addition to the vertical vector distortion the septum has the effect of converting the square waveguide into a ridged waveguide which has the effect of capacitive center loading. This effectively lowers the waveguide cutoff frequency and thereby lowers the phase velocity. This has the effect of slowing the vertical component relative to the horizontal component. If the tapered section is made to have a length that will retard the vertical signal by one quarter wavelength, the circular polarization will be converted into linear.

Thus when the signals represented by the vectors in sections **18*v* and 18*h* arrive at section 15' they are no longer in spatial phase quadrature. The signals in section 15' will result from the simple vector addition of the signals present as shown at sections 18*v* and 18*h*. Thus, as can be seen, the signals cancel in the right hand rectangular waveguide and reinforce in the left hand rectangular waveguide. If the circularly polarized signal at section 14' had the opposite polarization (rotates in the opposite direction), it would couple entirely to the right hand rectangular waveguide at section 15'** and cancel in the left hand rectangular waveguide.

When a linearly polarized signal is applied at section 14' both rectangular waveguides at section 15' will be excited. For vertical polarization the output waveguides will be excited out of phase with each other. For horizontal polarization the output waveguides will be excited in the same phase. For intermediate polarization the signal phasing in the two waveguides will be at intermediate phasing.

Thus the device of FIGS. 1A, 1B, and 1C is a polarization transducer. The two output signals will be a function of the polarization of the input signal. It should be noted that the device is reciprocal in that a signal applied to one rectangular waveguide will produce a circularly polarized signal at the square waveguide. If the other rectangular waveguide is excited the signal at the square waveguide will be oppositely circularly polarized.

The above theory of operation clearly indicates that there will be an optimum septum taper and measurements verify this. In other words making the taper either too steep or too gradual is to be avoided. This is at odds with what one might expect from casual inspection. Ordinarily, in waveguide operation, the more gradual the discontinuity, the less the disturbance of waveguide propagation.

The fact that there is an optimum taper leads to the problem that the simple tapered septum divider has limited bandwidth capability. The typical waveguide fractional bandwidth of the device of FIG. 1A is on the order of 25% of the nominal or center frequency. While this is a useful value, it leaves much to be desired to terms of modern microwave practice.

DESCRIPTION OF THE INVENTION

Figure 3A:
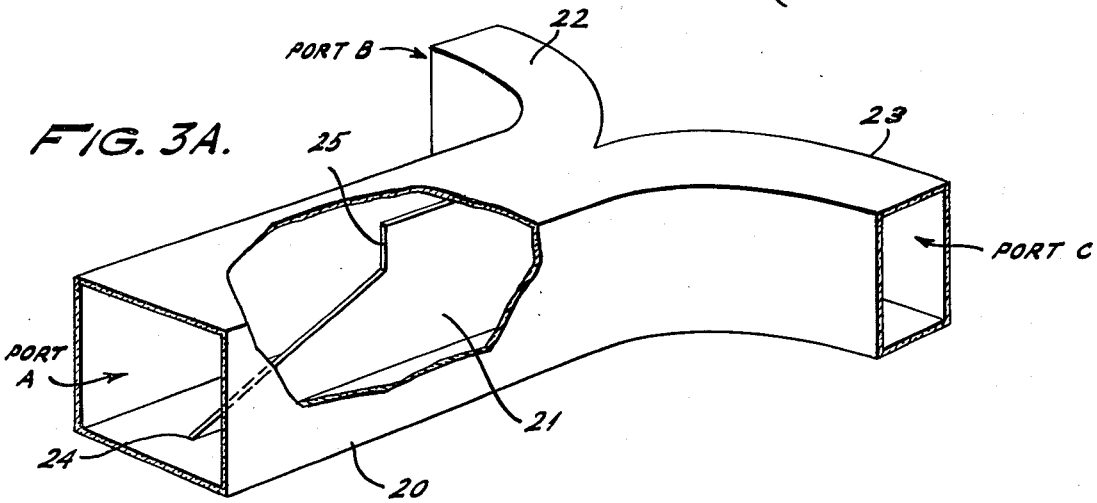
FIG. 3A is a cutaway section of a transducer employing the invention.

FIG. 3A shows a practical form of three port transducer. In accordance with the invention a septum 21 of special shape is employed. Waveguide 20 has a square cross section so that input port A will accept a signal of any polarization. Septum 21 divides the square waveguide into two rectangular output sections 22 and 23 which may be flared as shown to comprise output ports B and C. Septum 21 starts at 24 as a conventional tapered section and terminates in an essentially transverse portion at 25. The taper between 24 and 25 is as was described above and is optimized so that at the nominal center frequency of the transducer the taper produces a 90-degree shift in delay between horizontal and vertical signal components. The height of the transverse portion at 25 is adjusted so that the series impedance of the output waveguides 22 and 23 matches the impedance of the ridged waveguide at the point of the transverse portion at 25. It is this latter condition that produces a marked improvement when practicing the invention. In the simple tapered septum of the prior art the output waveguides are connected to the end of the taper which is clearly a short circuit since the septum extends completely across the waveguide. By using the septum shape of FIG. 3A, there will be a lower VSWR looking into port A when ports B and C are matched. For this condition the waveguide fractional bandwidth will be over 50% of nominal center frequency. This is an increase in bandwidth of two times.

Figure 3B:
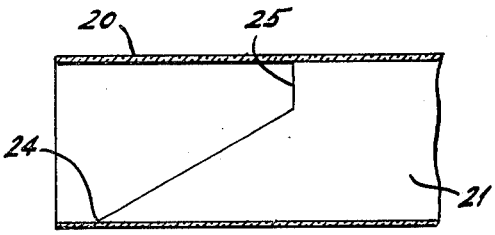
FIG. 3B is a side view of the septum of FIG. 3A.
Figure 3C:
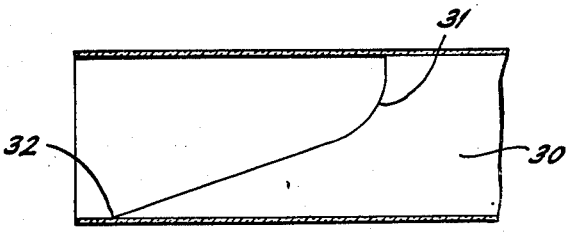
FIG. 3C shows a septum having a preferred shape.

FIG. 3B shows the septum of FIG. 3A in side view. FIG. 3C shows in side view an effective variation of the septum shape. Septum 30 has a continuous curvature thus avoiding any abrupt discontinuities. The tapered section is adjusted to provide a linear phase shift with travel along the waveguide between orthogonal polarizations. The transverse portion 31 gradually curves into a taper which terminates at 32. The dimensions approximate those of FIG. 3B and the same general properties apply except that the VSWR is lower over the operating band and the bandwidth slightly greater.

The transducer of FIG. 3A has the polarization sensitive properties as described in connection with FIGS. 1A, 1B, 1C, and 2. The performance of such a transducer has the characteristics of isolation and axial ratio. Isolation, which is expressed in dB, is a measure of the ratio of the outputs at ports B and C when a circularly polarized signal is applied to port A. Axial ratio is the departure from circular polarization in port A when either port B or port C is excited.

Example

A transducer was constructed in accordance with FIG. 3A. The axial ratio was less than one dB over a 50% waveguide fractional band and the isolation was better than 20 dB over a 50% waveguide fractional band.

My invention has been described and its improvement over the prior art shown. Clearly there are alternatives and equivalents that will occur to a person skilled in the art. For example, while square waveguide has been shown, the septum of the invention will apply to round waveguide or other shapes. In addition the square waveguide could, through a transition section, connect to round waveguide. Also the rectangular waveguide sections could couple to other waveguide types and/or transmission line devices. Accordingly, it is intended that my invention be limited only by the following claims.

I claim:

1. A transducer comprising:

a first waveguide capable of supporting propagation of transverse electric signals of any polarization, and a septum dividing said first waveguide into a pair of waveguides each of which can support transverse electric signals of only one polarization, said septum having a tapered portion extending from a point on one wall of said first waveguide to a point closer to but spaced from the opposite wall of said first waveguide and a transverse portion extending across a part of said first waveguide from said tapered portion to said opposite wall, said taper being angled to optimize the transfer of electrical energy between said first waveguide and said pair of waveguides, and said transverse portion first having a dimension that matches the series impedance of said pair of waveguides to the impedance of said first waveguide at the position of said transverse portion.

2. The transducer of claim 1 wherein said septum has a continuous curvature wherein said taper is increased gradually to blend into said transverse portion.

3. The transducer of claim 2 wherein said waveguide is square in cross section and said pair of waveguides each have a rectangular cross section.

4. A three port transducer comprising:

a first section of waveguide capable of supporting transverse electric signals of any polarization and having a central ridge, said ridge having zero height at one end of said first section and gradually rising from a point on one wall to a predetermined height less than the height of said first section at the other end, a pair of rectangular waveguides with their broad faces joined together at one extremity thereof, said waveguides in combination having the same width as said first section, means for joining said first section to said pair of rectangular waveguides so that the common face of said pair produced by said joining at said extremity abuts said ridge and is joined thereto at said predetermined height to form a transverse section extending from said ridge to the opposite wall of said first section, and, a second section of waveguide capable of supporting transverse electric signals of any polarization joined to said first section wherein the open end of said second section along with the unjoined ends of said pair of rectangular waveguides comprise said three ports of said transducer.

5. The transducer of claim 4 wherein the length of said ridge and said predetermined height are selected to optimize signal transfer between said ports and to match the series impedance of said pair of rectangular waveguides to the impedance of said first section at said other end.

6. The transducer of claim 5 wherein said first section is square and said pair of rectangular waveguides in combination have the same dimensions as said first section.

7. The transducer of claim 6 wherein the juncture between said ridge and said pair of waveguides produces a tapered septum in said waveguide that terminates in a transverse portion having a face substantially perpendicular to said opposite wall.

8. The transducer of claim 7 wherein said septum is shaped so that said transverse portion is blended into said taper in a gradual curving manner to avoid any abrupt discontinuities in said septum.

* * * * *